313-414 3R
1/22/85 XR 4,495,439

United States Patent [19]

Shimoma et al.

[11] Patent Number: 4,495,439

[45] Date of Patent: Jan. 22, 1985

[54] MAGNETIC FOCUSING TYPE CATHODE RAY TUBE

[75] Inventors: Taketoshi Shimoma, Isezaki; Kumio Fukuda; Toshio Shimaoogi, both of Fukaya, all of Japan

[73] Assignee: Tokyo Shibaura Denki Kabushiki Kaisha, Kawasaki, Japan

[21] Appl. No.: 411,364

[22] Filed: Aug. 25, 1982

[30] Foreign Application Priority Data

| | | | |
|---|---|---|---|
| Sep. 2, 1981 | [JP] | Japan | 56-137004 |
| Sep. 2, 1981 | [JP] | Japan | 56-137005 |
| Sep. 2, 1981 | [JP] | Japan | 56-137006 |
| Sep. 2, 1981 | [JP] | Japan | 56-137007 |
| Sep. 2, 1981 | [JP] | Japan | 56-137008 |

[51] Int. Cl.[3] ..... H01J 29/64; H01J 29/51

[52] U.S. Cl. ..... 313/412; 313/413; 313/414

[58] Field of Search ..... 313/414, 412, 413

[56] References Cited

U.S. PATENT DOCUMENTS

| | | | |
|---|---|---|---|
| 3,866,080 | 2/1975 | Barkow | 313/412 |
| 4,310,780 | 1/1982 | Sakurai et al. | 313/414 X |

FOREIGN PATENT DOCUMENTS

| | | | |
|---|---|---|---|
| 35450 | 3/1980 | Japan . | |
| 43758 | 3/1980 | Japan | 313/414 |
| 37715 | 3/1980 | Japan | 313/412 |
| 1502011 | 2/1978 | United Kingdom . | |

*Primary Examiner*—Palmer Demeo
*Attorney, Agent, or Firm*—Cushman, Darby and Cushman

[57] ABSTRACT

A magnetic focusing type cathode ray tube includes a magnetic yoke assembly, for magnetically focusing and converging three in-line electron beams, having a pair of magnetic yokes opposing each other with a predetermined gap therebetween. The magnetic cylinders on the cathode side are so formed as to have a strong magnetic shield effect while the magnetic cylinders on the screen side are weak in magnetic shield effect. The radial components in the magnetic field produced in the magnetic gap, which act on the side beams in a direction perpendicular to an in-line direction, are reverse in polarity on the cathode side and screen side so that radial components emerge so as to converge the beams in a tube axis direction.

9 Claims, 10 Drawing Figures

MAGNETIC FOCUSING TYPE CATHODE RAY TUBE

BACKGROUND OF THE INVENTION

This invention relates to a cathode ray tube, and more particularly, to a magnetic focusing type cathode ray tube.

A prior art cathode ray tube includes an electrostatic focusing type of cathode ray tube and a magnetic focusing type of cathode ray tube. But, it is only the former type of cathode ray tube that is already being put to practical use. As compared with this former type, however, the latter type of cathode ray tube has a high resolution, and necessitates no focusing voltage with the result that its power source circuit is simplified and the problems of withstanding voltage are lessened. For this reason, the reliability is enhanced with respect to this latter type, and the manufacturing cost thereof is decreased at the same time. Under these circumstances, developments continue for practical applications of the magnetic focusing type cathode ray tube.

Meanwhile, the prior art magnetic focusing type cathode ray tube uses an electron gun of magnetic focusing lens system, which is comprised of a cathode member and a focusing magnetic yoke assembly. An in-line type electron gun has three cathodes arranged in an in-line form and a pair of magnetic yokes each having electron beam passing holes corresponding to those cathodes, respectively. The magnetic yokes are disposed in opposed relationship to each other and are coupled by a pair of permanent magnets. For example, the permanent magnets are positioned above and below a central electron beam path, respectively, so that they have their N pole on the cathode side and their S pole on the screen side. Further, each magnetic yoke is provided with cylindrical magnetic elements protruding from the periphery of its electron beam passing holes.

In the above-mentioned electron gun, the magnetic force lines generated from the N pole of the permanent magnets are absorbed into the cylindrical magnetic elements of the magnetic yoke of the S pole side from those of the magnetic yoke of the N pole side, and thus are returned to the S pole of the permanent magnets. At this time, focusing magnetic fields are formed in the magnetic gaps between the cylindrical magnetic elements of the magnetic yokes placed in opposed relationship to each other. That is, a focusing magnetic field is formed in each of the three electron beam paths with a result that the electron beams from the cathodes are focused by the action of the focusing magnetic fields thus formed. Ideally, a complete magnetic focusing of the electron beams is obtained solely by the action of the magnetic fields of the permanent magnets alone. Actually, however, there is a magnetic field directed from the N pole side, i.e., the cathode side yoke to the cathode, and from the screen to the S pole side, i.e., to the screen side yoke. These external magnetic fields have a deflecting effect upon the side electron beams, which are thus deflected vertically. As a result, when the three electron beams are converged by a 4-pole magnet of ring shape mounted outside of the neck portion, the resultant beam spot has an elliptical shape, and bring about to lower a focusing precision.

SUMMARY OF THE INVENTION

Accordingly, the object of the invention is to provide a magnetic focusing type cathode ray tube which permits the self-convergence of electron beams to be made to give a proper beam spot.

According to the present invention, an in-line electron gun is disposed within a neck portion of a glass envelope, and has a magnetic yoke assembly for magnetically converging and focusing three electron beams. The magnetic yoke assembly is comprised of a first cylindrical yoke member located on the cathode side and having a length permitting a sufficient magnetic shield effect to be obtained, and a second cylindrical yoke member located on the screen side in an opposed relationship to the first cylindrical yoke member and having a length set to permit the magnetic shield effect to weaken. Each of the first and second cylindrical yoke members has at least three yoke cylinders. The yoke cylinders of the first cylindrical yoke member are opposed to those of the second one with a prescribed magnetic gap existing therebetween, respectively. The yoke cylinders of the first yoke member and those of the second yoke member are made asymmetrical with respect to the magnetic gap so that the radial component of the magnetic field created in the magnetic gap may have a polarity opposite to that of the magnetic field created outside of the yoke member located on the screen side.

DETAILED DESCRIPTION OF THE PREFERRED EMBODIMENTS

Figure 1:
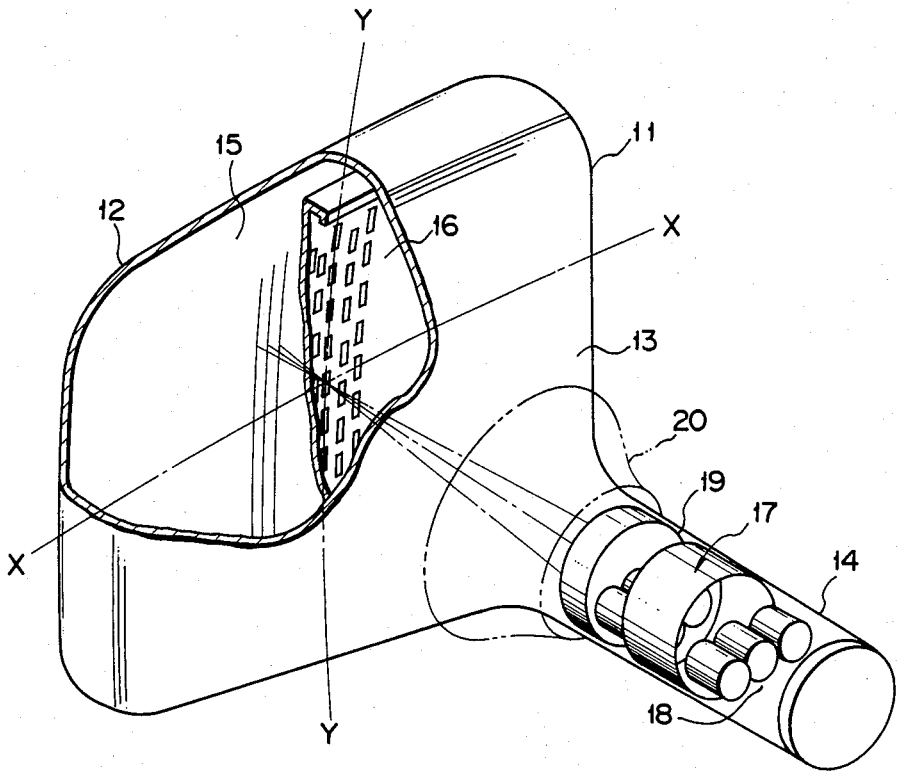
FIG. 1 is a perspective view of a magnetic focusing type cathode ray tube according to an embodiment of the invention.

Referring to FIG. 1, a glass envelope 11 is comprised of a face plate 12, a funnel portion 13 formed integrally with the face plate 12, and a neck portion 14 formed integrally with the funnel portion at the rear end thereof. The face plate 12 is formed, at its inner face, with, for example, a black striped phosphor screen 15. A slotted shadow mask 16 is provided facing the screen 15. Within the neck portion, an electron gun 17 is arranged. The electron gun 17 is comprised of three cathodes 18 arranged in an in-line form and a magnetic yoke assembly 19 provided forward of the cathodes 18. A deflection coil 20 is fitted onto the joining portion between the funnel portion and the neck portion.

The subject matter of the present invention resides in the magnetic yoke assembly 19 of the electron gun 17 incorporated in the cathode ray tube of FIG. 1. Hereafter, explanation will be made of the operational principle of the present invention.

Figure 2:
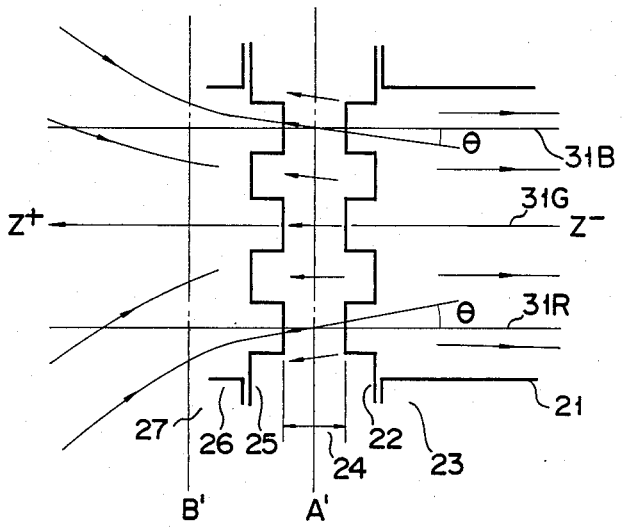
FIG. 2 is a view of the distribution of the magnetic force lines acting within the electron gun explaining the operational principle of the magnetic focusing type cathode ray tube according to the invention.

In FIG. 2, the magnetic yoke assembly 19 is schematically shown. On the cathode side, there is provided a cathode side yoke member 23 comprised of a long magnetic yoke 21 and a magnetic yoke 22 having electron beam passing holes. On the screen side, there is provided a screen side yoke member 27 comprised of magnetic yoke 25 opposed to the magnetic yoke 22 of the yoke member 23 at a prescribed magnetic gap from the same and having electron beam passing holes, and a short magnetic yoke 26 located approximate to the magnetic yoke 25.

Figure 3:
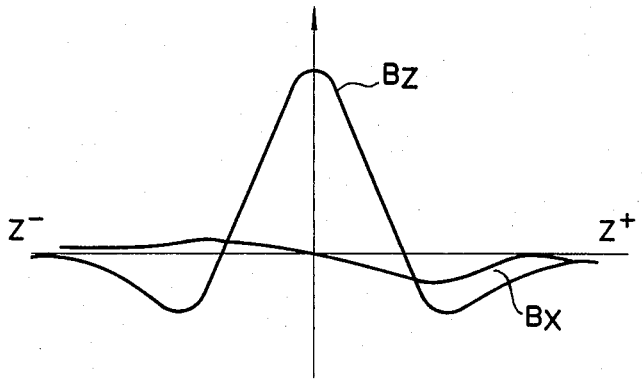
FIG. 3 is a view showing the characteristics of the magnetic density in the electron gun.

When three electron beams, i.e., blue, green and red electron beams 31B, 31G and 31R are made incident upon the magnetic yoke assembly 19 from the cathode 18, they enter the magnetic gap 24 through the electron beam passing holes of the magnetic yoke 22 without receiving any substantial effect of the deflecting magnetic field in the long magnetic yoke 21. At this time, magnetic fields are applied to the electron beams in the direction going toward the screen side as indicated by the arrows. That is, with respect to the central electron beam 31G, the magnetic field is applied in the direction coaxial with the electron gun 17, i.e., beam traveling direction Z+. With respect to the side electron beams 31B and 31R, the magnetic fields are applied in an outward direction defining a prescribed angle $\theta$ with respect to the beam traveling direction Z+. That is, the magnetic fields containing deflecting magnetic components are applied to the side electron beams 31B and 31R. The magnetic field shown in FIG. 3 explains the electron beam 31R. In FIG. 3, a magnetic field Bz is a focusing magnetic field, while a magnetic field Bx is a deflecting magnetic field component.

Figure 4:
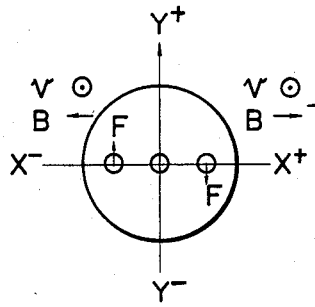
FIG. 4 is a view explaining the action of the magnetic forces, taken along the line A—A of FIG. 2.
Figure 5:
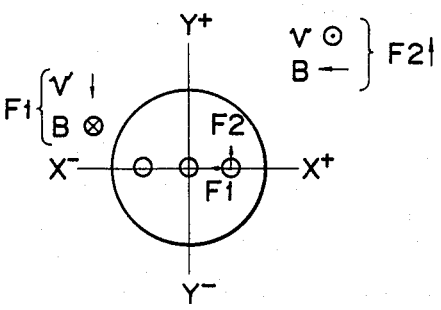
FIG. 5 is a view explaining the action of the magnetic forces, taken along the line B—B of FIG. 2.

The magnetic force acting in the line A—A of the magnetic gap 24 upon the electron beams 31B, 31G and 31R is as shown in FIG. 4. Since the red electron beam 31R is subjected to a magnetic field applied in the direction X+, the magnetic force acts thereupon in the direction Y− in accordance with the Fleming's Law. In contrast, on the blue electron beam 31B, the magnetic force acts in the direction Y+. When the electron beams 31B, 31G and 31R, passing through the magnetic gap 24 and the magnetic yoke member 27, travel toward the screen 15, namely in the direction Z+, the side electron beams 31B and 31R receive the effect of the deflecting magnetic field component B of the magnetic yoke 26 set to have a weak magnetic shield effect and residual deflecting magnetic field component Bx. For example, in the line B—B of FIG. 2, the magnetic field acts on the side electron beams 31B and 31R as shown in FIG. 5. In this line B—B, the electron beam 31R travels with a (Z+) directional velocity Vz and a (Y−) directional velocity −Vy and is applied with a magnetic field −Bz in the (Z−) direction and with a magnetic field −Bx in the (X−) direction. Accordingly, upon the electron beam 31R there act the magnetic forces $Fx=-(-Vy)\times(-Bz)$ and $Fy=-(Vz)\times(-Bx)$. That is, the electron beam 31R tends to travel in the directions X− and Y+. However, the (Y+) directional velocity component is canceled by the (Y−) directional velocity component applied in the line A—A of FIG. 2, so that the Y directional velocity components are made zero. Thus, only the (X−) directional velocity component is applied to the side electron beam 31R. Similarly, the velocity component acting in the opposite direction to that (X−) direction, i.e., acting in the (X+) direction is applied to the blue electron beam 31B. Accordingly, the side electron beams 31B and 31R are converged toward the central electron beam 31G.

Figure 6:
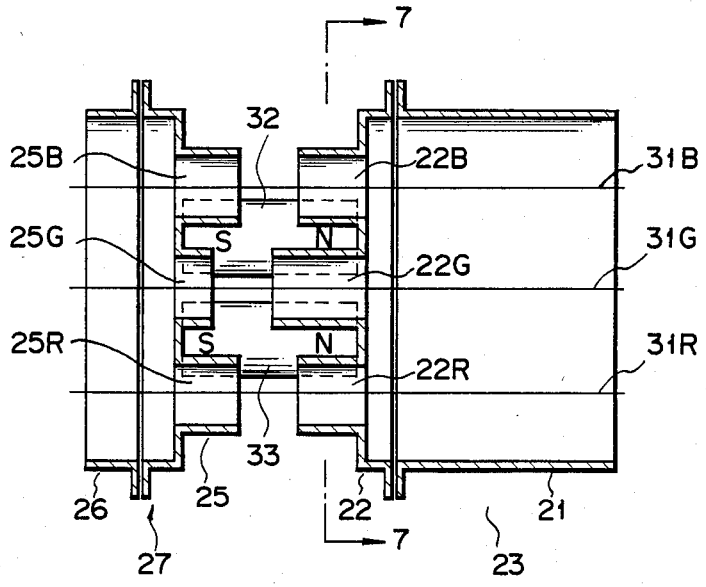
FIG. 6 is a sectional view of a magnetic yoke assembly used in the electron gun of the magnetic focusing type cathode ray tube according to the invention.
Figure 7:
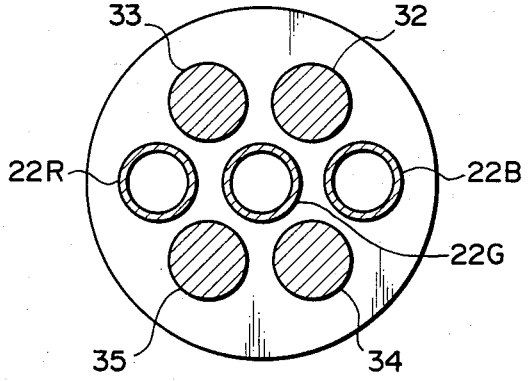
FIG. 7 is a sectional view of the magnetic yoke assembly, taken along the line 7—7 of FIG. 6.

The present invention is directed to effecting the focusing and converging of the electron beams 31B, 31G and 31R in accordance with the above-mentioned operating principle. The magnetic yoke assembly 19 of the invention is constructed to permit the magnetic field to act on the electron beams in the above-mentioned manner. In FIG. 6, the magnetic yoke assembly 19 according to the above-mentioned first embodiment of the invention is shown. In this magnetic yoke assembly 19, the opposed magnetic yokes 22 and 25 are provided with magnetic cylinders 22B and 22R, and 25B and 25R permitting the passage of the side electron beams 31B and 31R, and magnetic cylinders 22G and 25G permitting the passage of the central electron beam 31G, respectively. The side magnetic cylinders 22B, 22R, 25B and 25R have the same length. In contrast, the central magnetic cylinder 22G of the magnetic yoke 22 is longer than the magnetic cylinders 22B and 22R and the magnetic cylinder 25G of the magnetic yoke 25 is shorter than the magnetic cylinders 25B and 25R. In this case, the space intervals, i.e., magnetic gaps between the magnetic cylinders 22B, 22G and 22R of the magnetic yoke 22 and the magnetic cylinders 25B, 25G and 25R of the magnetic yoke 25 are equalized with each other. Four permanent magnets 32, 33, 34 and 35 generating the focusing magnetic fields are clamped between the magnetic yokes 22 and 25 so that they have their S pole on the screen side and their N pole on the cathode side as shown in FIGS. 6 and 7. In this case, the magnets 33 and 35 are disposed mutually opposed on the substantial center line between the magnetic cylinders 22R and 22G, while the magnets 32 and 34 are disposed mutually opposed on the substantial center line between the magnetic cylinders 22G and 22B.

In the magnetic yoke assembly 19 of FIG. 6, since the magnetic force lines concentrate onto a portion small in magnetic reluctance, in the magnetic yoke 22 the magnetic field is liable to concentrate onto the central magnetic cylinder 22G, while in the magnetic yoke 25 the magnetic field is liable to concentrate onto the side magnetic cylinders 25B and 25R. As a result, the magnetic field formed between the magnetic yokes 22 and 25 has, in the side magnetic cylinders 22B, 25B and 22R, 25R, deflecting components acting outwardly of the magnetic yoke assembly 19. That is, as shown in FIG. 2, the side electron beams 31B and 31R are deflected in the Y direction by the magnetic field directed to the outside at the angle $\theta$ defined with respect to the beam traveling direction Z+. This deflection angle $\theta$ can be varied to any given value by varying the ratio of the height or length of the central magnetic cylinder to that of the side cylinders. The side electron beams 31B and 31R thus deflected in the magnetic yoke 26 of the screen side undergo the action of the deflecting force as explained in connection with FIG. 5 with the result that the Y directional deflecting component, i.e., Y directional velocity component are canceled. Thus, those side electron beams are converged onto the central electron beam. The Y directional deflecting component, that is, the deflecting component acting in the Y direction can be set to any given value by varying the length and the shape of the screen side cylindrical magnetic yoke 26. It should be noted here that the cathode side cylindrical magnetic yoke 21 is constructed so that it has a length and shape permitting its internal magnetic field to become fully uniform in density and to exert no deflecting force upon the electron beams 31B, 31G and 31R.

Figure 8:
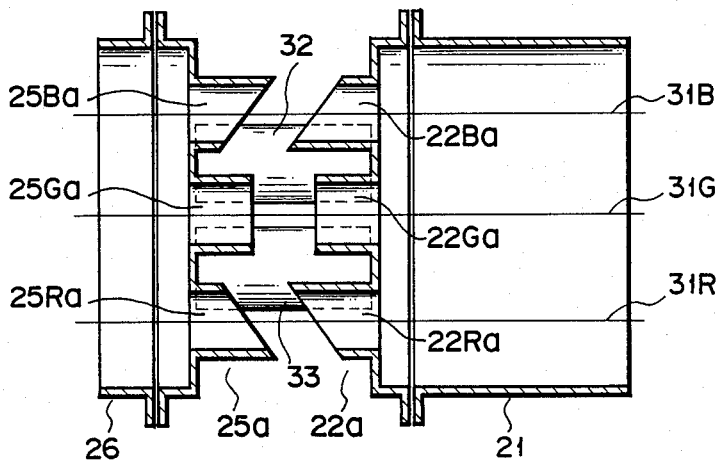
FIG. 8 is a sectional view of a magnetic yoke assembly of the magnetic focusing type cathode ray tube according to another embodiment of the invention.

According to a second embodiment shown in FIG. 8, the magnetic yokes 22*a* and 25*a* have magnetic cylinders 22B*a*, 22R*a* and 25B*a*, 25R*a* which are formed with inclined end faces, respectively. The inclined end faces of the magnetic cylinders 22B*a* to 25R*a* are all inclined in the direction in which the electron beam passes through the central magnetic cylinder 25G*a* of the screen side magnetic yoke 25*a*, that is, in the direction Z+. And those end faces are made parallel to each other. In other words, in the magnetic yoke 22*a*, each of the side magnetic cylinders 22B*a* and 22R*a* gradually increases in height toward the advancing path of the central beam 31G. In contrast, each of the side magnetic cylinders 25B*a* and 25R*a* of the magnetic yoke 25*a* gradually decreases in height toward the central beam 31G.

In the magnetic yoke assembly 19 shown in FIG. 8, the magnetic force lines are concentrated onto the higher or longer portions of the magnetic cylinders 22B*a*, 22R*a*, 25B*a* and 25R*a*. Accordingly, in the magnetic cylinders 22B*a* and 22R*a*, the magnetic field becomes more intense toward the inner side, while in the magnetic cylinders 25B*a* and 25R*a* the magnetic field becomes more intense toward the outer side. As a result, the side electron beams 31B and 31R receive the action of the deflecting force in the Y direction. Thereafter, the action similar to that explained in connection with the magnetic yoke assembly 19 of FIG. 6 is exerted upon the electron beams 31B and 31R. According to this second embodiment of the invention, the displacement of the side electron beams 31B and 31R in the Y direction can be varied to any given value by varying the angle of inclination of the end faces of the magnetic cylinders 22B*a* to 25R*a*.

Figure 9:
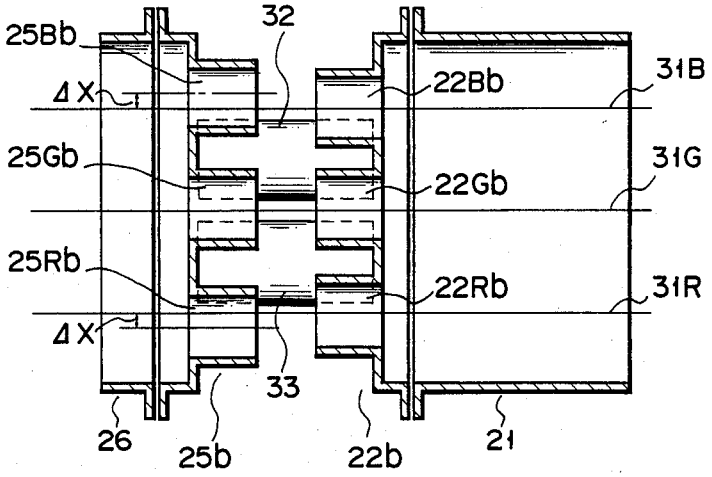
FIG. 9 is a sectional view of a magnetic yoke assembly of the magnetic focusing type cathode ray tube according to still another embodiment of the invention.

According to a third embodiment shown in FIG. 9, the magnetic cylinders 22B*b*, 22G*b* and 22R*b* of the cathode side magnetic yoke 22*b* and the magnetic cylinders 25B*b*, 25G*b* and 25R*b* of the screen side magnetic yoke 25*b* are each formed to have the same height or length. However, the central axis of each of the side magnetic cylinders 25B*b* and 25R*b* of the screen side magnetic yoke 25*b* is outwardly deviated by a prescribed value $\Delta x$ from the central axis of a corresponding one of the side magnetic cylinders 22B*b* and 22R*b* of the magnetic yoke 22*b*.

In the magnetic yoke assembly 19 shown in FIG. 9, since the magnetic force lines advance toward the side magnetic cylinders 25B*b* and 25R*b* small in magnetic reluctance, the side magnetic fields are turned outwards. Accordingly, the side electron beams 31B and 31R are deflected in the Y direction. The deflection quantity can be varied by varying the said prescribed value $\Delta x$. The other operations are the same as those explained in connection with FIG. 8.

Figure 10:
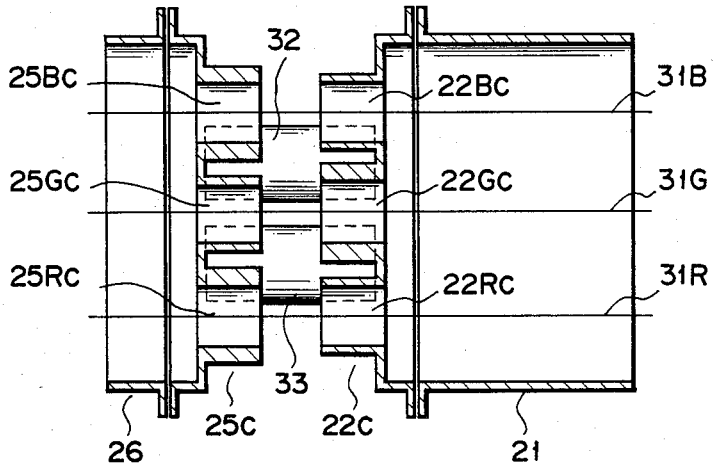
FIG. 10 is a sectional view of a magnetic yoke assembly of the magnetic focusing type cathode ray tube according to a further embodiment of the invention.

According to a fourth embodiment shown in FIG. 10, the central magnetic cylinder 22G*c* of the cathode side magnetic yoke 22*c* is formed to have a thickness greater than that of the side magnetic cylinders 22B*c* and 22R*c* thereof. In contrast, the side magnetic cylinders 25B*c* and 25R*c* of the screen side magnetic yoke 25*c* are formed to have a thickness greater than that of the central magnetic cylinder 25G*c* thereof. However, the magnetic cylinders 22B*c*, 22G*c* and 22R*c* on the cathode side are made coaxial with, and same in height as, the magnetic cylinders 25B*c*, 25G*c* and 25R*c* on the screen side, respectively.

In the magnetic yoke assembly 19 of FIG. 10, the magnetic cylinders 25G*c*, 25B*c* and 25R*c* although greater in thickness are small in magnetic reluctance. Accordingly, in the magnetic yoke 22*c*, the magnetic field is concentrated onto the central magnetic cylinder 22G*c*, while in the magnetic yoke 25*c* the magnetic field is concentrated onto the side magnetic cylinders 25B*c* and 25R*c*. As a result, the side electron beams 31B and 31R are deflected in the Y direction as in the preceding embodiments.

As explained above in detail, the present invention provides a magnetic focusing type cathode ray tube having the electron gun including a magnetic yoke assembly wherein the magnetic yokes are provided on both the cathode side and screen side in such a manner as to have asymmetrical shapes with respect to the magnetic gap therebetween so that in this magnetic gap wherein the electron beams are converged the magnetic field applied to the central electron beam may differ in magnetic density from that applied to the side electron beams, and wherein the magnetic shield effect is strengthen on the cathode side and weak on the screen side. Accordingly, the concentration of the three electron beams can be obtained with high precision by suitably varying the asymmetrical shapes of the magnetic yokes. Since adjustment of these asymmetrical shapes can be made in a simple manner and since the present cathode ray tube can perform both the focusing and the converging of the electron beams without separately providing the convergence yoke, the present cathode ray tube has wide applicability and is simple in construction and easy to assemble.

In the above-mentioned embodiments, the magnetic cylinders are provided to project from the magnetic yoke. In this invention, however, they can be provided to go into the interior of the magnetic yoke. Further, the cylindrical magnetic yoke constructed to commonly enclose all of the three electron beams is substituted for a flattened cylindrical tube. Further, the permanent magnets generating the magnetic fields are not limited to four. Further, the magnets may be disposed so that they have their N pole on any side of the cathode and screen sides. In this case, however, it is necessary that they be disposed so that the N poles of all the magnets are on the same side.

What is claimed is:

1. A cathode ray tube, comprising:

a cathode ray tube envelope having a face plate formed with a screen, a funnel portion integrally provided on said face plate, and a neck portion integrally provided on said funnel portion;

means for generating magnetic fields within an electron gun device; and said electron gun device, disposed within said neck portion, comprising a cathode and a magnetic yoke, adjacent to said cathode with a magnetic gap therebetween, said device generating electron beams in in-line form, and said magnetic yoke including:

a first yoke, disposed on the cathode side of said magnetic gap and having a passage therein permitting the passage of the electron beams therethrough, a second yoke, disposed on the screen side of said magnetic gap, and having a passage therein permitting the passage of said electron beams therethrough and magnetically asymmetrical with said first yoke;

a third yoke disposed adjacently between said first yoke and said cathode, providing a strong magnetic shield effect against any magnetic fields generated by said means for generating magnetic fields;

a fourth yoke, disposed adjacent to said second yoke providing a weak magnetic shield effect against any magnetic fields generated by said means for generating magnetic fields; and said magnetic yoke constituting means for causing one of the radial components of the magnetic field in said magnetic gap to have an opposite polarity to that of other magnetic fields present, the radial component of a magnetic field in said magnetic gap defining a prescribed angle with respect to a beam traveling direction.

2. The cathode ray tube according to claim 1, wherein said magnetic field generating means is comprised of a plurality of permanent magnets coupled between said first and second yoke and so provided as to sandwich, from both sides, a flat plane including said in-line electron beams.

3. The cathode ray tube according to claim 2, wherein said permanent magnets are so provided as to sandwich a flat plane between two of said electron beams.

4. The cathode ray tube according to claim 1, 2 or 3, wherein said first yoke has a central magnetic yoke cylinder and side magnetic yoke cylinders disposed on both sides of said central magnetic yoke cylinder and having a length different from that of said central magnetic yoke cylinder; and said second yoke has central and side magnetic yoke cylinders having a length asymmetrical to that of said central and side magnetic yoke cylinders of said first yoke.

5. The cathode ray tube according to claim 1, 2 or 3, wherein said first yoke has a central magnetic yoke cylinder having a flat end face and side magnetic yoke cylinders disposed on both sides of said central magnetic yoke cylinder and respectively having inclined end faces which are inclined so that respective portions of said side magnetic yoke cylinders closer to said central magnetic yoke cylinder differ in height from the opposite portions of said side magnetic yoke cylinders; and said second yoke has a central magnetic yoke cylinder corresponding to said central magnetic yoke cylinder of said first yoke and side magnetic yoke cylinders having inclined end faces asymmetrical with those of said side magnetic yoke cylinders of said first yoke.

6. The cathode ray tube according to claim 1, 2 or 3, wherein said first yoke has a central magnetic yoke cylinder and side magnetic yoke cylinders disposed on both sides of said central magnetic yoke cylinder; and said second yoke has a central magnetic yoke cylinder corresponding to said central magnetic yoke cylinder of said first yoke and side magnetic yoke cylinders disposed on both sides of said central magnetic yoke cylinder of said second yoke and having central axes outwardly deviated from those of said side magnetic yoke cylinders of said first yoke.

7. The cathode ray tube according to claim 1, 2 or 3, wherein said first yoke has a central magnetic yoke cylinder having a prescribed wall thickness and side magnetic yoke cylinders disposed on both sides of said central magnetic yoke cylinder and having a wall thickness less than that of said central magnetic yoke cylinder; and said second yoke has central and side magnetic yoke cylinders having a wall thickness asymmetrical with that of said central and side magnetic yoke cylinders of said first yoke.

8. The cathode ray tube according to claim 1, 2 or 3, wherein said third yoke is constituted by a long cylindrical yoke enclosing said in-line electron beams on a common basis.

9. The cathode ray tube according to claim 1, 2 or 3, wherein said fourth yoke is constituted by a short cylindrical yoke enclosing said electron beams on a common basis and having only a weak magnetic shield effect.

* * * * *